US008376040B2

(12) United States Patent
Birkeland et al.

(10) Patent No.: US 8,376,040 B2
(45) Date of Patent: Feb. 19, 2013

(54) CUTTING DEVICE AND A METHOD FOR EMERGENCY CUTTING OF A LINE IN A WELL

(75) Inventors: Petter Birkeland, Tananger (NO); Oyvind Koldal, Stavanger (NO)

(73) Assignee: Smart Installations AS (NO)

( * ) Notice: Subject to any disclaimer, the term of this patent is extended or adjusted under 35 U.S.C. 154(b) by 523 days.

(21) Appl. No.: 12/522,883

(22) PCT Filed: Jan. 9, 2008

(86) PCT No.: PCT/NO2008/000008

§ 371 (c)(1),
(2), (4) Date: Jan. 29, 2010

(87) PCT Pub. No.: WO2008/085062

PCT Pub. Date: Jul. 17, 2008

(65) Prior Publication Data

US 2010/0139921 A1 Jun. 10, 2010

(30) Foreign Application Priority Data

Jan. 12, 2007 (NO) ..... 20070217

(51) Int. Cl.
*E21B 29/04* (2006.01)

(52) U.S. Cl. ..... 166/54.5; 166/54.6; 166/298

(58) Field of Classification Search ..... 166/54.5, 166/54.6, 298
See application file for complete search history.

(56) References Cited

U.S. PATENT DOCUMENTS

| | | | | |
|---|---|---|---|---|
| 1,491,610 | A | 4/1924 | Liady | |
| 1,855,853 | A * | 4/1932 | Gallman et al. | 166/54.6 |
| 1,867,033 | A | 7/1932 | Spang | |
| 3,962,943 | A * | 6/1976 | Allen | 83/370 |
| 2004/0089451 | A1 | 5/2004 | Palmer et al. | |
| 2008/0251258 | A1 * | 10/2008 | Bamford | 166/355 |

FOREIGN PATENT DOCUMENTS

| | | | |
|---|---|---|---|
| NO | 20050511 | A | 3/2005 |
| WO | WO 2005003504 | A2 * | 1/2005 |

OTHER PUBLICATIONS

International Search Report for parent application PCT/N02008/000008, having a mailing date of Apr. 15, 2008.

* cited by examiner

*Primary Examiner* — Giovanna Wright
*Assistant Examiner* — Richard Alker
(74) *Attorney, Agent, or Firm* — Andrus, Sceales, Starke & Sawall, LLP

(57) ABSTRACT

A cutting device and a method for emergency cutting of a line in a well are disclosed. The cutting device includes a tapering guide including a narrow end portion and a wide end portion for feed-through of the line, the narrow end portion being placed, when in its position of use, at a lower position than that of the wide end portion; at least one sliding block arranged axially movable within the tapering guide; at least one cutting knife connected to the sliding block and directed inwards in the tapering guide; at least one releasable holding mechanism for standby holding of the at least one sliding block at the wide end portion of the guide, and for releasing the at least one sliding block in connection with emergency cutting of the line. Upon release, the at least one sliding block will move downward in the direction of the narrow end portion of the guide where it will force its at least one cutting knife with increasing force against the line until it is cut off.

61 Claims, 5 Drawing Sheets

CUTTING DEVICE AND A METHOD FOR EMERGENCY CUTTING OF A LINE IN A WELL

CROSS-REFERENCE TO RELATED APPLICATIONS

Figure 1:
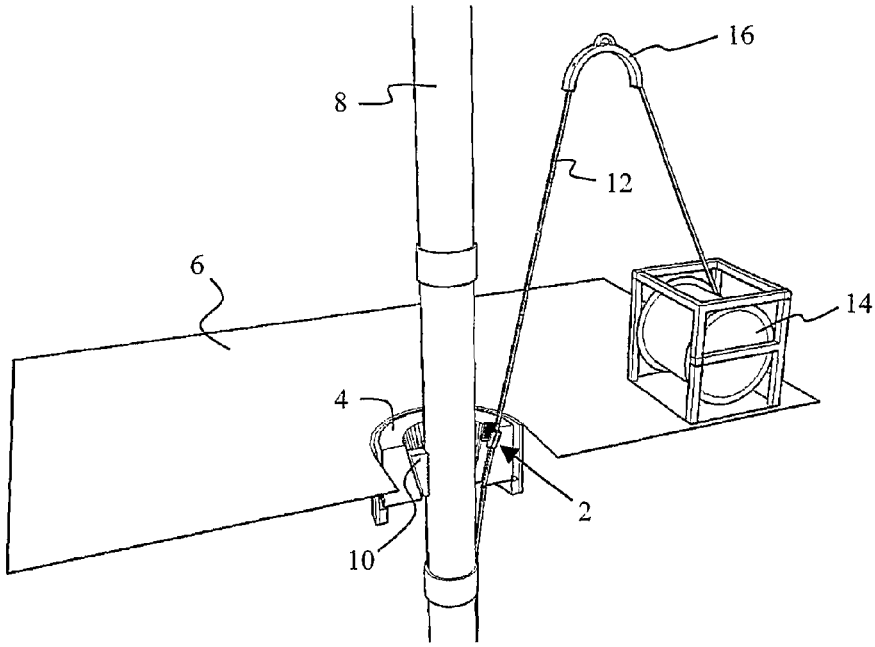

This application is the U.S. national stage application of International Application No. PCT/NO2008/000008, filed Jan. 9, 2008, which International application was published on Jul. 17, 2008, as International Publication No. WO 2008/085062 A1 in the English language, which application is incorporated herein by reference. The International application claims priority of Norwegian Patent Application No. 20070217, filed Jan. 12, 2007, which application is incorporated herein by reference.

THE AREA OF INVENTION

The present invention concerns a cutting device and a method for emergency cutting of a line in a well, for example a hydrocarbon well, injection well or water well.

It should be possible, by means of the present invention, to cut off the line in a controlled manner at an upper portion of the well, for example on or nearby a drilling floor or platform deck for the well. In order to avoid damage to personnel or equipment, the cutting is preferably activated remotely. Typically, such a cutting situation may arise in connection with the running in or pulling out, so-called tripping, of a well string to which said line is connected. For example, the well string may be comprised of a completion string.

BACKGROUND OF THE INVENTION

Gradually it has become customary, especially in connection with recovery of hydrocarbons, to use various equipment and components being introduced into a well in order to improve the course of recovery in some way. Such downhole well equipment may comprise various measuring apparatuses, actuators, displacable or rotatable sleeves or valve devices, pumping equipment, etc. The present invention, however, does not depend on the type of downhole equipment used in this connection.

Oftentimes said well equipment requires one or several lines to be extended to surface in order to connect the equipment in the well to corresponding equipment on surface. Typically, such lines are used for energy transmission, fluid transmission and signal communication. As such, the lines may comprise optical-fibre or electric cables/lines for transmission of energy or signals, for example control signals and well data. They may also comprise fluid transmission lines/pipes, for example hydraulic lines, coiled tubings or similar, for transmission of energy, control signals and various well treatment fluids. Thus, the present line includes different types of transmission means of different shape and/or material type, and of more or less flexible design.

During said tripping of the well string, at least one such line will be connected to the well string. When running into the well, the line(s) is/are continuously connected to the well string. When pulling out of the well, the line(s) is/are continuously disconnected from the well string. Under both circumstances, the non-connected portion of such a line is spooled off and onto, respectively, a corresponding spooling unit placed at the well's surface or in the vicinity thereof, for example standing on a drilling floor or being suspended from a winch above the wellbore. Normally, such a spooling unit is large and heavy.

During the tripping operation, however, unforeseen events may occur and give rise to the well string unintentionally being dropped or lowered far too fast into the wellbore. By so doing, the line(s) connected to the well string will also accompany the well string in its uncontrolled trip into the wellbore. This will cause the line(s) to be be spooled out in an uncontrolled manner from a spooling unit nearby. In a worst case scenario in a deep well, the well string and the line(s) may drop several thousands of metres. Such an uncontrolled unspooling may cause uncontrolled movement of both the spooling unit(s) and the line(s), which brings about great danger both to personnel and equipment located in the vicinity of this uncontrolled event. Should the line(s) also become torn off in this connection, a fishing operation must be initiated in the well in order to retrieve both the well string and the line(s), which is time-consuming and costly.

On the basis of dangers and disadvantages associated with such an uncontrolled unspooling of one or several line(s), it would therefore prove very advantageous for the the line(s) to be cut off as soon as possible, and in a safe manner for personnel and quipment. Such an endeavour offers the possibility of limiting the harmful effects of the uncontrolled unspooling.

PRIOR ART

The applicant does not know of any technical solutions for cutting of one or several lines during uncontrolled unspooling thereof into a well. Common practice in such a situation is for personnel to withdraw as soon as possible from the area in which the uncontrolled unspooling takes place.

As background prior art, however, the following publications are mentioned:

U.S. Pat. No. 1,491,610 (American patent); and

NO 20050511 (Norwegian patent application).

Both of these publications relate to cutting devices for controlled cutting of a line in a region down within a well. The cutting is carried out after having placed the line in the well. Moreover, an upwardly directed force must be used to cut off the line for both of these cutting devices.

THE OBJECT OF THE INVENTION

The primary object of the invention is to provide a technical solution for allowing one or several such well-string-connected lines to be cut off as soon as possible when in an emergency situation.

It is also an object to provide a technical solution allowing said cutting to be carried out in a safe manner preventing damage to personnel and equipment immediately after having cut off the line. For example, such damage may occur in the event that energy inherent in an extended, elastic line suddenly becomes liberated when the line is cut off. Thus, the line located above the cutoff place may bounce back with intense force and cause damage to the surroundings. If the line is comprised of a fluid transmission line, such a sudden cutoff may result in undesirable discharge of fluids and potential harmful effects on the surroundings.

HOW TO ACHIEVE THE OBJECT

The object is achieved by virtue of features disclosed in the following description and in the subsequent claims.

According to a first aspect of the invention, a cutting device for emergency cutting of at least one line introduced into a well is provided. In the following, this line will only be referred to as one line.

The cutting device is arranged for connection to the well in a suitable position relative to the well. The device is also arranged for incorporation of the line when the device is connected to the well and is located in its position of use. The cutting device comprises the following features:

- a tapering guide including a narrow end portion and a wide end portion for feed-through of the line, the narrow end portion being placed, when in its position of use, at a lower position than that of the wide end portion;
- at least one sliding block arranged axially movable within the tapering guide; and
- at least one cutting knife connected to the sliding block and directed inwards toward the centre of the tapering guide.

The distinctive characteristic of the cutting device is that it also comprises:

- at least one releasable holding mechanism for standby holding of the at least one sliding block at the wide end portion of the guide, and for releasing the at least one sliding block in connection with emergency cutting of the line.

Upon release, the at least one sliding block will move downward in the direction of the narrow end portion of the guide where the sliding block will force its at least one cutting knife with increasing force against the line until it is cut off. Thereby, the portion of the line located below the cutoff place will drop down into the well. This will prevent a large length of the line to be spooled out and be pulled down into the well, including the time- and cost-related disadvantages associated therewith.

In a first embodiment variant, the tapering guide may be assembled from at least two axially extending and non-parallel face elements, for example in the form of plates. Such a guide structure is easy to incorporate into or assemble with other borehole-related equipment used at the upper end of the well, for example on a drilling floor or platform deck at the surface of the borehole, or at the upper end of a riser or similar connected to the borehole, as in an offshore situation. For example, such borehole-related equipment may comprise a borehole slips or a borehole bushing typically used on a drilling floor.

In a second embodiment variant, the tapering guide may be comprised of a conical funnel, which may have e.g. a circular or other suitable cross-section. This guide structure may be formed as an enclosing unit, for example a housing. Such a form may be advantageous should it prove desirable to assemble the present cutting device with external borehole-related equipment, which for example is placed on, at or above a drilling floor or platform deck and in vicinity of the well. Thus, the cutting device may be assembled with, for example, a sheave wheel connected to a drawworks or a winch, or assembled with a spool or drum for the line in question.

The present cutting device may include only one sliding block. Upon release, the sliding block will force its at least one cutting knife with increasing force against one side of the line, whereas the opposite side of the line is forced in a supporting manner against the guide.

Alternatively, the cutting device may include at least two sliding block. Upon release, the sliding blocks will move downward and force its cutting knives with increasing force against the line. Preferably, the the cutting knives are arranged in scissor configuration for clipping off the line.

Yet further, a sliding side of the sliding block may be provided with at least one axially extending guide track arranged for cooperation with at least one axially extending guide strip provided at an inside of the guide.

Alternatively, a sliding side of the sliding block may be provided with at least one axially extending guide strip arranged for cooperation with at least one axially extending guide track provided at an inside of the guide.

A gripping side of the sliding block may include an axially extending gripping face bevelled toward an inside of the guide in the direction of its wide end portion. Advantageously, this gripping face may form an angle which, relative to a longitudinal axis through the guide, is larger than that of a corresponding angle formed by the inside of the guide. The latter feature ensures optimum force transmission to the cutting knives during the cutting. In order to intensify the cutting effect, the sliding block may also include at least one weight for gravity-assisted movement of the sliding block upon release thereof.

The sliding block may also include a magnet-affectable material. Thereby, the releasable holding mechanism of the cutting device may be comprised of an electromagnet for releasable standby holding of the magnet-affectable sliding block.

Advantageously, the releasable holding mechanism may be connected to a remote control device for remotely controlled release of the holding mechanism.

As mentioned above, a portion of the line located above the cutoff place, and also any sliding blocks, may bounce back after the cutting and cause damages to the surroundings. Yet further, the cutting of a potential fluid transmission line may also result in undesirable discharge of fluids from the line. It is therefore advantageous for both the overlying line portion and the at least one sliding block to be held tight at the cutoff place after the cutting. Preferably, this is carried out by keeping said sliding block and its cutting knife forced against the overlying line portion until a controlled liberation thereof may be carried out. Such a squeezing and fixing will also prevent a potential fluid discharge.

For example, this fixing may be carried out by arranging a recoil brake or recoil clutch, which is separate from the cutting device, around the line at the surface of the well, e.g. on or in vicinity of a drilling floor. The recoil brake/-clutch is activated during the cutting of the line and is squeezed in a braking and locking manner against the line, preferably via remote control or automatic activation.

As an alternative or addition to such a separate brake device, the cutting device may also comprise at least one releasable locking mechanism for locking of the at least one sliding block in a region at the narrow end portion of the guide after cutting off the line.

Preferably, the releasable locking mechanism is arranged for locking engagement between the at least one sliding block and the tapering guide. For example, this may be achieved by virtue of said sliding block being provided with at least one locking dog, whereas the guide is provided with at least one cooperating locking groove. Alternatively, said sliding block may be provided with at least one locking groove, whereas the guide is provided with at least one cooperating locking dog.

Such a locking dog may take on the form of a tooth, knob, pin, pawl or similar protruding element arranged for locking engagement with a suitable locking groove, for example a recess, hollow, tooth bottom, flute or terminal edge.

Preferably, said locking dog is arranged movable relative to the locking groove, for example via reciprocating, linear motion or rotary motion. Alternatively, the locking groove may be arranged movable relative to the locking dog.

Advantageously, the locking dog may be biased in an extended position for engagement with a cooperating locking groove when aligned opposite one another. The locking dog may also take on a form and/or position allowing for locking in the locking groove upon attempts of relative movement in one direction, but allowing for relative movement in the opposite direction, as within a ratchet. For example, a coil spring or gas spring may be used to bias the locking dog in the extended position. Other types of devices may also be used for this purpose, for example electromagnets or pneumatic, hydraulic or electric actuators.

Typically, the latter devices will be arranged for reciprocating movement. Thus, the devices may also be used for releasing the locking dog from locking engagement with a cooperating locking groove, and for moving the locking dog to a retracted, free position. Depending on the specific embodiment of the cutting device, such a device may be provided within, or in connection with, either the tapering guide or the sliding block, and it must also be able to move the locking dog with sufficient force. Such a device may also be used together with a coil spring, gas spring or similar biasing device. For example, a coil spring may thus be used to bias the locking dog in the extended position, whereas an electromagnet may be used to move the locking dog to the rectracted, free position. When the locking dog is in the free position, the at least one sliding block and the overlying line portion may be liberated from the guide, whereby the liberated line portion may be pulled out of the well in a controlled manner.

Thus, said axially extending guide strip at the inside of the guide may be provided with transverse flutes, whereas the sliding block may be provided with a spring-loaded and movable locking knob extending inwards toward said axially extending guide track in the sliding block for engagement with said flutes on the guide strip. Alternatively, the guide strip of the guide may be provided with a spring-loaded and movable locking knob/locking pawl arranged in a manner allowing it to spring out behind the upper terminal end of the sliding block after having been led past the knob/pawl during the cutting, as in a catch lock.

As an alternative to the above-mentioned, releasable locking mechanisms, the inside of the tapering guide may be formed with Morse taper for self-locking of the at least one sliding block when being forced against the guide during cutting of the line. In connection with manufacturing of tools and machine parts in drilling- and cutting machines, it is common to use Morse taper in fastening parts for such machines, for example in a so-called Morse taper sleeve or tool taper. Preferably, this locking mechanism comprises a release device, for example in the form of a pull rod, push rod or launching wedge, which is used to liberate the sliding block from the self-locking engagement with the guide. Such a release device may be provided within, or in connection with, the guide. For example, the release device may be driven by virtue of an electromagnet or a pneumatic, hydraulic or electric actuator.

Yet further, the releasable locking mechanism is preferably connected to a remote control device for remotely controlled release thereof subsequent to said locking of the at least one sliding block in a region at the narrow end portion of the guide.

In its position of use by the well, the cutting device may be incorporated in a borehole slips, for example a spider-type borehole slips.

The cutting device may also be incorporated in a borehole bushing.

As a further alternative, the cutting device may be connected to a sheave wheel for use in connection with spooling of the line. Normally, such a sheave wheel is connected to a winch or a drawworks.

According to a second aspect of the invention, a method for emergency cutting of a line in a well is provided, the method comprising the following steps:

using a cutting device comprising the following features:

a tapering guide including a narrow end portion and a wide end portion;

at least one sliding block arranged axially movable within the tapering guide; and at least one cutting knife connected to the sliding block and directed inwards toward the centre of the tapering guide; and connecting the cutting device to the well and placing the narrow end portion at a lower position than that of the wide end portion.

The distinctive characteristic of the method is that it further comprises the following steps:

using a cutting device which also comprises at least one releasable holding mechanism for the at least one sliding block;

by means of said holding mechanism, holding the at least one sliding block in a standby position at the wide end portion of the guide;

introducing the line through the cutting device and into the well; and when emergency cutting of the line is required, releasing said holding mechanism and thereby liberating the at least one sliding block.

After being released, the sliding block will move downward in the direction of the narrow end portion of the guide where it will force its at least one cutting knife with increasing force against the line until it is cut off.

According to the method, said holding mechanism may be released by means of remote control.

According to the method, a cutting device which also comprises at least one releasable locking mechanism for locking of the at least one sliding block in a region at the narrow end portion of the guide after cutting off the line, may also be used. Preferably, said locking mechanism may be released by means of remote control after locking of the at least one sliding block at the narrow end portion of the guide.

Yet further, a recoil brake or recoil clutch, which is separate from the cutting device, may be arranged around the line at the surface of the well.

Moreover, the cutting device may be incorporated in a borehole slips, for example a spider-type borehole slips.

The cutting device may also be incorporated in a borehole bushing.

As a further alternative, the cutting device may also be connected to a sheave wheel for spooling of the line.

In connection with the present method, reference is also made to details described hereinbefore in connection with the present cutting device.

SHORT DESCRIPTION OF THE DRAWINGS

Figure 2:
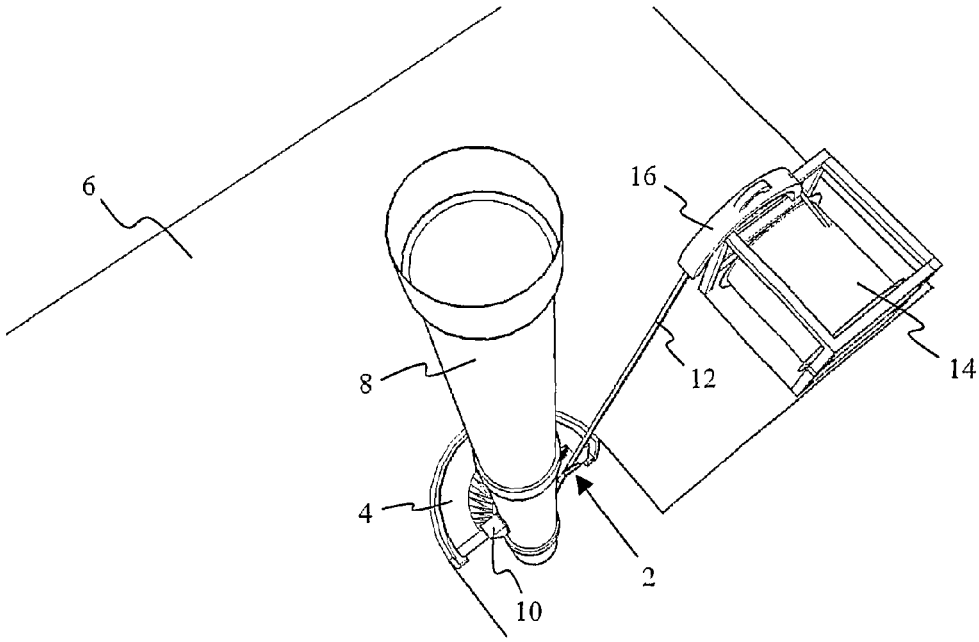
Figures 3A, 3B, 3C, 3D:
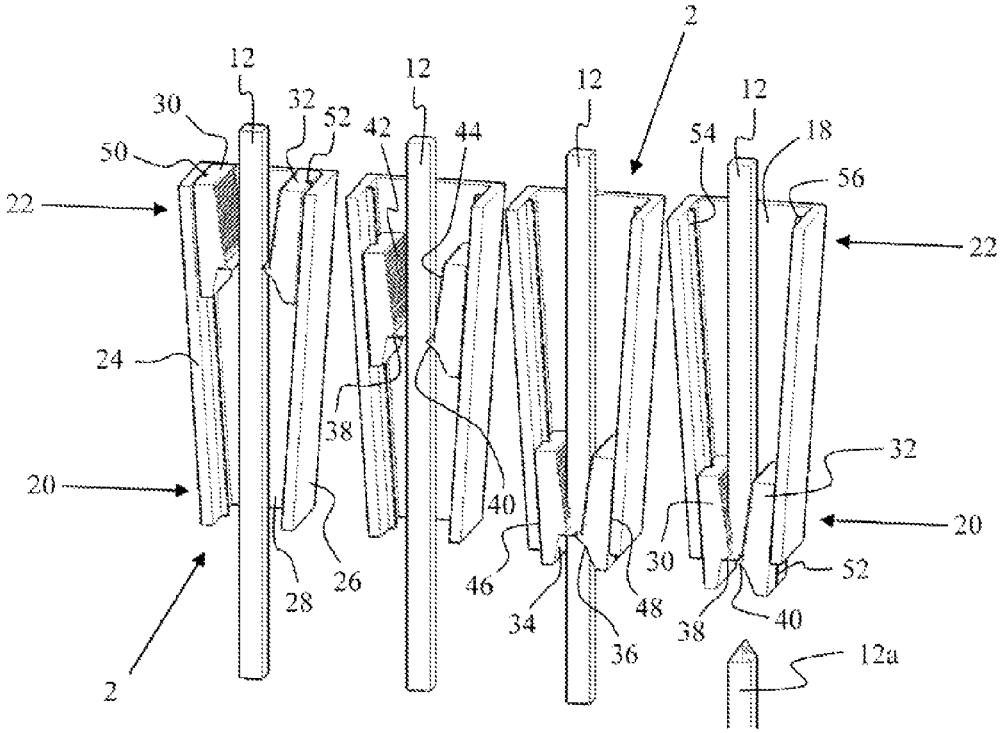
Figure 4:
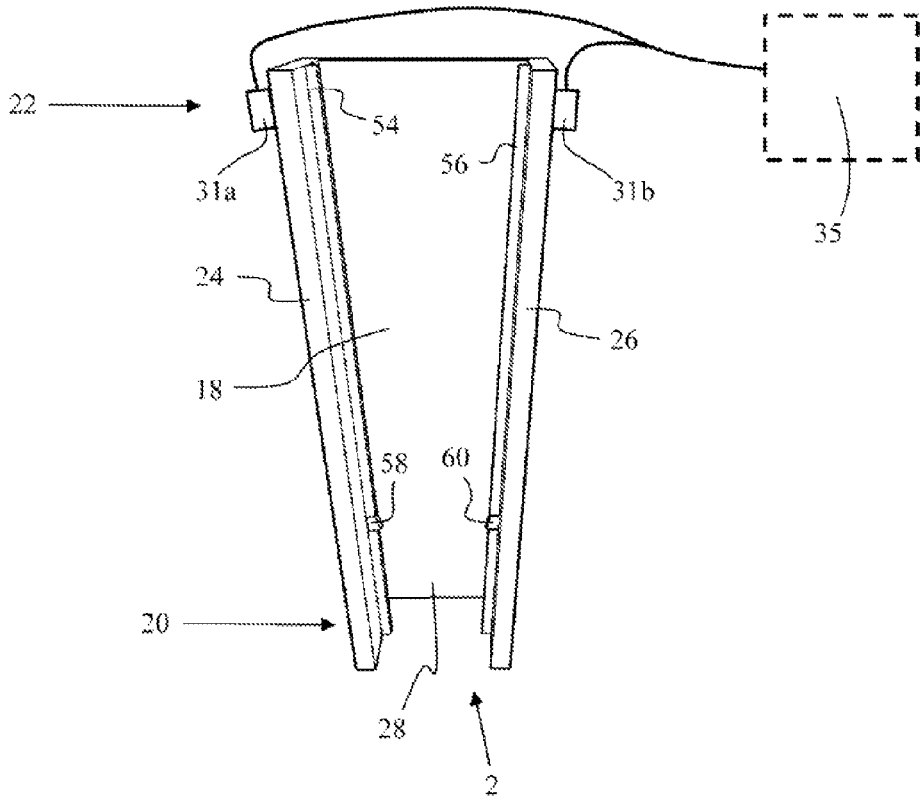
Figure 5:
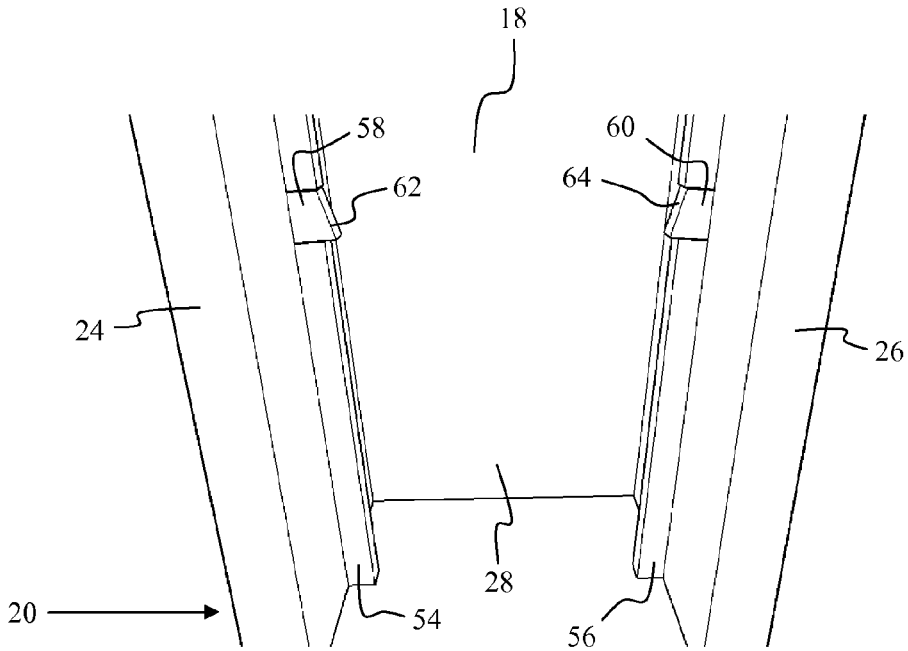
Figure 6:
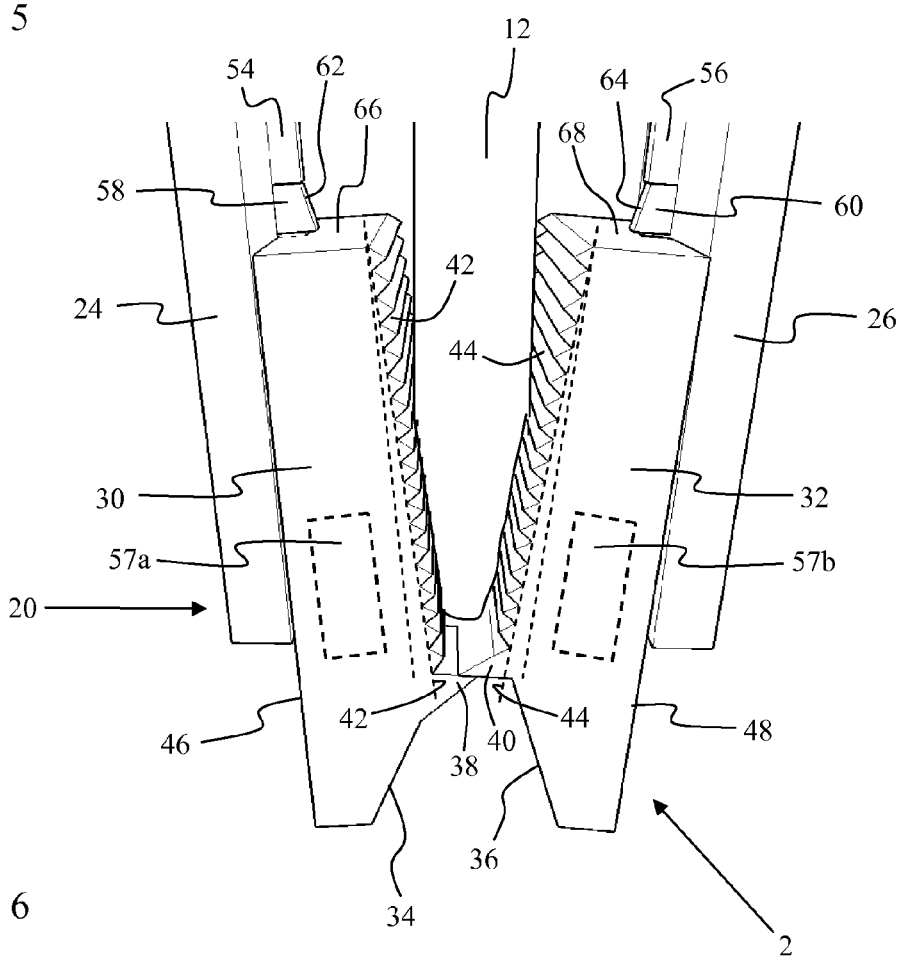
Figure 7:
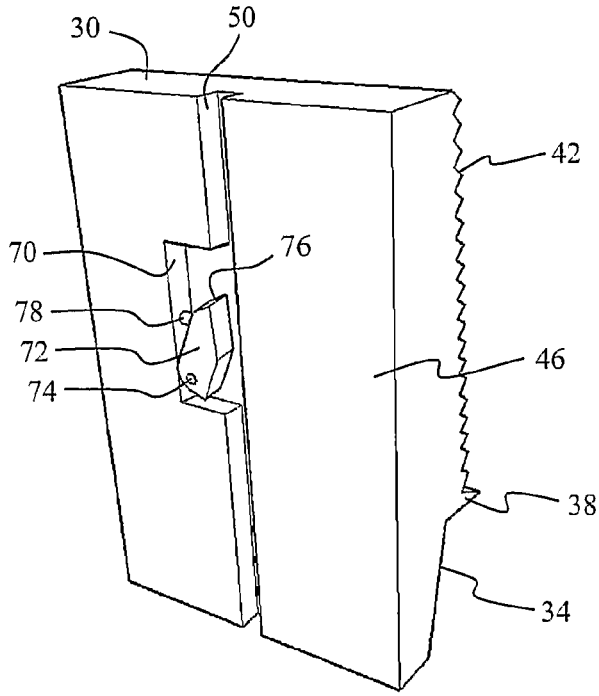
Figure 8:
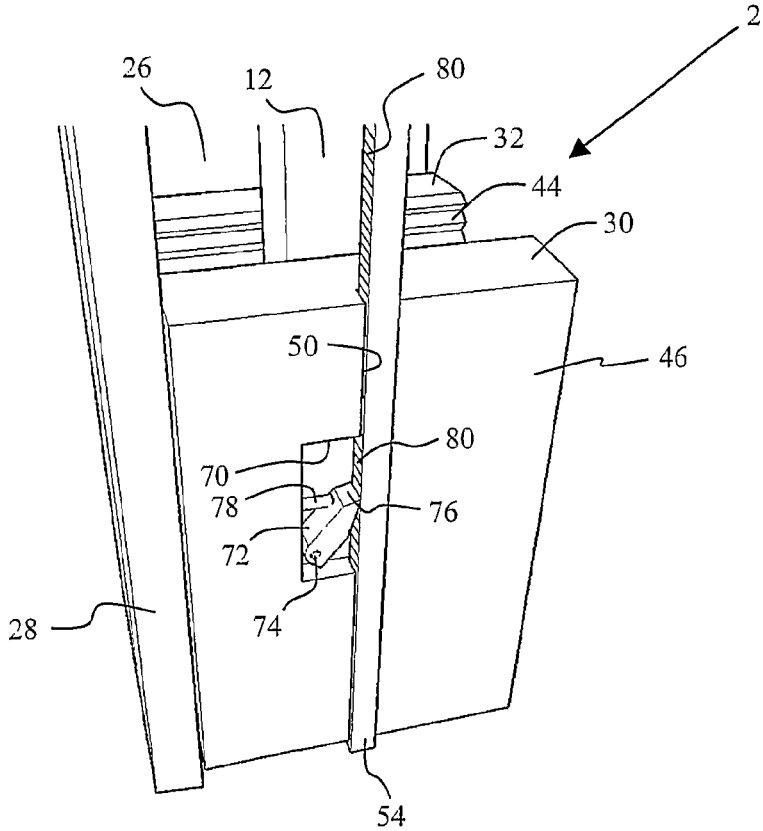
Figure 9:
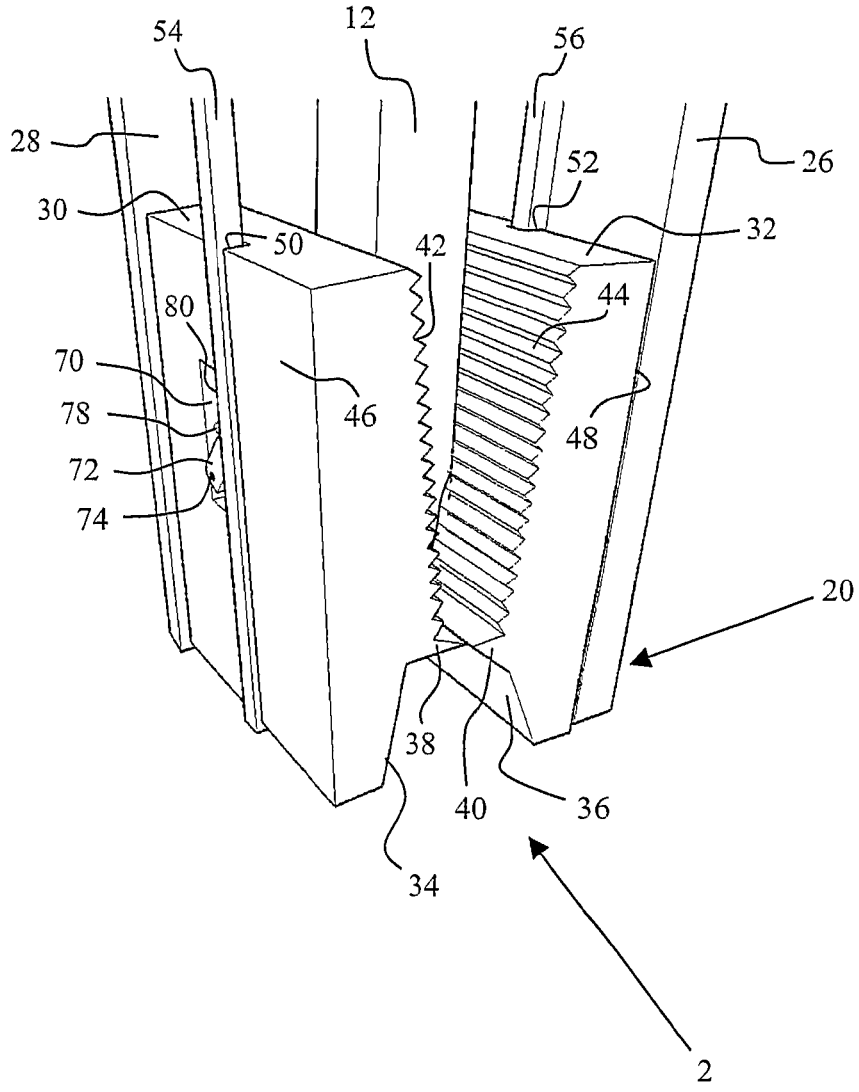

In the following, different embodiment examples of the present invention will be shown, in which:

FIG. 1 is a perspective drawing showing one embodiment of the present invention in connection with introduction of a completion string and an associated electric line in a well, wherein the cutting device is mounted in a borehole bushing in a drilling floor, and wherein the electric line simultaneously is spooled out from a drum and is inserted via the cutting device for connection to the completion string;

FIG. 2 shows the same course of events as those of FIG. 1, but seen in a bird's-eye view;

FIGS. 3*a*-3*d* are perspective drawings showing structural features of the cutting device and also four instant situations thereof whilst mounted in its position of use and having said electric line inserted therethrough, in which FIG. 3*a* shows the cutting device in standby mode, whereas FIGS. 3*b*-3*d* show a successive course of motion within the cutting device after release for emergency cutting of the line, and in which FIG. 3*d* shows the line when cut off;

FIGS. 4-6 are perspective drawings showing, in different scales, a first variant of a releasable locking mechanism for locking of the sliding blocks of the cutting device, in which FIG. 6 shows the sliding blocks locked off against the line after being cut off; and FIGS. 7-9 are perspective drawings showing a second variant of a releasable locking mechanism for locking of the sliding blocks of the cutting device, in which FIGS. 8-9 show the sliding blocks locked off against the line after being cut off.

The figures are schematic and may be somewhat distorted with respect to relative size and relative placement of components being part of the embodiment examples of the invention. In general, identical or corresponding details of the figures will be denoted with the same or similar reference numerals in the following.

Embodiment Examples of the Invention

FIGS. 1 and 2 show a cutting device 2 according to the invention when mounted in a conical borehole bushing 4 in a drilling floor 6 in connection with the introduction of a completion string 8 in a well (not shown). In connection with the joining of a new pipe string length (not shown), the completion string 8 is shown temporarily fixed within the borehole bushing 4 by means of a wedge 10 (possibly a slips). Simultaneously, an electric line 12 is spooled out from a drum 14 and further via the cutting device 2 for subsequent fixing to the completion string 8. In this embodiment, the line 12 comprises several electric lines being assembled in a joint line. In this case, and due to said line assembly, the line 12 has a rectangular cross-section (shown best in FIGS. 3*a*-3*d*). In order to get a suitable insertion angle into the well and through the cutting device 2, the line 12 is spooled out via a U-shaped bail 16, which is suspended above the drilling floor 6 and is connected to a winch (not shown).

FIGS. 3*a*-3*d* show four instant situations of the cutting device as it will appear whilst mounted in its operational position in the borehole bushing 4, and having the electric line 12 inserted therethrough. For the sake of clarity, only the cutting device 2 and the line 12 are shown in the figures. FIG. 3*a* shows the cutting device 2 arranged in its standby position, and prior to release for emergency cutting of the line 12. FIGS. 3*b*-3*d*, however, show a successive course of motion within the cutting device 2 after release thereof, the course of which is terminated by the line 12 being cut off, as shown in FIG. 3*d*. The cut off line portion 12*a*, which is located below the cutoff place, will thus drop down into the well.

FIGS. 3*a*-3*d* also show significant structural features of the cutting device 2. Thus, the cutting device 2 comprises a tapering guide having, in this embodiment example, the form of a conical box 18, which includes a narrow end portion 20 and and overlying, wide end portion 22 for feed-through of the line 12. The conical box 18 is assembled from two axially extending and non-parallel side plates 24, 26 mounted perpendicular onto a support plate 28. The box 18 is open vis-à-vis the support plate 28 and outwardly toward the centre of the borehole bushing 4.

The cutting device 2 also comprises two sliding blocks 30, 32 arranged axially movable within the conical box 18 and each along a side plate 24, 26 of their own. The sliding blocks 30, 32 are aligned opposite one another, whereby the line 12 is located therebetween.

On their gripping sides 34 and 36, the sliding blocks 30, 32 are provided each with a cutting knife 38, 40 directed inwards toward the centre of the conical box 18 and against the line 12. In order to achieve an efficient scissor configuration when clipping off the line 12, one cutting knife 38 is placed at a somewhat lower position than that of the other cutting knife 40. Yet further, and in order to achieve an efficient grip against the line 12 during emergency cutting, the gripping sides 34, 36 of the sliding block 30, 32 are provided each with an axially extending and fluted gripping face 42, 44 positioned opposite the respective cutting knife 38, 40. In this embodiment example, each gripping face 42, 44 is bevelled toward the inside of the box 18 in the direction of its wide end portion 22. See the dashed lines in FIG. 6 along the fluted gripping faces 42, 44, illustrating said bevels. This ensures optimum force transmission to the cutting knives 38, 40 during emergency cutting of the line 12.

On their sliding sides 46 and 48, the sliding block 30, 32 are provided each with an axially extending guide track 50, 52. Such a guide track 50 is shown best in FIGS. 7-9. In order to be able to assist said axial movement, each guide track 50, 52 is arranged for cooperation with an axially extending guide strip 54, 56 provided at the inside of each side plate 24, 26 of the conical box 18, cf. FIGS. 3*a*-3*d*, FIGS. 4-6 and FIGS. 8-9.

Yet further, the cutting device 2 comprises at least one releasable holding mechanism (see FIG. 4) for standby holding of the sliding blocks 30, 32 at the wide end portion 22 of the box 18, and for releasing the sliding blocks 30, 32 in connection with emergency cutting of the line 12. If the sliding blocks 30, 32 include a magnet-affectable material, said holding mechanism advantageously may be comprised of an electromagnet e.g. 31*a*, 31*b* for releasable standby holding of each of the sliding blocks 30, 32. For example, such an electromagnet 31*a*, 31*b* may be incorporated into the very box 18 or within said borehole bushing 4, and preferably it is connected to a remote control device shown schematically in FIG. 4 at 35 for remotely controlled release of the magnet.

Upon release, the sliding blocks 30, 32 will move downward in the direction of the narrow end portion 20 of the box 18 where they will force their cutting knives 38, 40 with increasing force against the line 12 until being cut off.

FIGS. 4-6 show a first variant of a releasable locking mechanism for locking of the sliding blocks 30, 32 of the cutting device 2 at the narrow end portion 20 of the box 18 after the cutting. In this embodiment, each guide strip 54, 56 has incorporated therein a locking dog in the form of a spring-loaded and linearly reciprocating locking pawl 58, 60 directed inwards toward the centre of the conical box 18. Each locking pawl 58, 60 is biased in an extended position by means of a coil spring (not shown) incorporated in each side plate 24, 26 of the box 18. Yet further, each locking pawl 58, 60 is provided with an outer bevel face 62, 64, a lower end thereof extending outside the respective guide strip 54, 56 when the locking pawl 58, 60 is biased in the extended position, but an upper end thereof being at the level of the guide strip 54, 56. This is shown best in FIG. 5. Thereby it is possible for the sliding blocks 30, 32 to move across and past the spring-loaded locking pawls 58, 60 during downwardly-directed movement in connection with cutting of the line 12. Once the upper terminal edges 66, 68 of the sliding blocks 30, 32 have moved past the locking pawls 58, 60, they will be pushed out behind the terminal edges 66, 68 due to said biasing. These terminal edges 66, 68 thus form locking grooves/-faces in this locking mechanism. By means of the locking pawls 58, 60 and the terminal edges 66, 68, the sliding blocks 30, 32 are arranged for locking engagement with the conical box 18. Thereby, the sliding blocks 30, 32 may be fixedly locked at the narrow end portion 20 of the box 18 after the cutting of the line 12, as in a catch lock. This is shown best in FIG. 6. In order then to liberate the sliding blocks 30, 32 and thus the line 12, the locking pawls 58, 60 must be released by virtue of being moved outwardly toward said side plates 24, 26 of the box 18, and to a retracted, free position. Advantageously, if the locking pawls 58, 60 include a magnet-affectable material, they may be connected each to an electromagnet (not shown) which, upon activation, pull the locking pawls 58, 60 outwardly toward the side plates 24, 26 and to said free position. For example, such an electromagnet may be incorporated into the very box 18 or within said borehole bushing 4, and preferably it is connected to a remote control device for remotely controlled release of the magnet.

FIGS. 7-9 show a second variant of a releasable locking mechanism for locking of each of the two sliding blocks 30, 32 at the narrow end portion 20 of the box 18 after having cut off the line 12. FIG. 7 shows the locking mechanism arranged within one sliding block 30, whereas FIGS. 8-9 show the sliding blocks 30, 32 cooperatively and fixedly locked around the cut off line 12 at the narrow end portion 20 of the box 18, the side plates 24, 26 thereof being removed for the sake of clarity.

FIG. 7 shows the sliding side 46 and the axially extending guide track 50 of the sliding block 30. A recess 70 is formed extending from one side of the guide track 50, said recess 70 having a locking dog in the form of a rotatable locking knob 72 placed therein. The inner edge of the locking knob 72 is rotatably connected to a rotary pin 74 fixed at the lower and inner corner of the recess 70, and perpendicular to the sliding side 46. The opposite and outer end of the locking knob 72 has the form of an asymmetric point 76 extending aslant upwards toward the guide track 50. A spring-loaded and linearly reciprocating activation pin 78 embodied in the sliding block 30 parallel to the sliding side 46 thereof, and also extending into the recess 70 in the direction of the guide track 50. The activation pin 78 bears against the locking knob 72 at the point 76 thereof. Yet further, the activation pin 78 is biased in an extended position by means of a coil spring (not shown) also being embodied in the sliding block 30. Thereby, also the locking knob point 76 will be biased and rotated outwardly toward the guide track 50. The other and cooperating sliding block 32 is arranged in a corresponding manner having its own locking mechanism.

FIG. 8 and FIG. 9 show this second variant of the locking mechanism whilst locking each of the two sliding blocks 30, 32 at the narrow end portion 20 after having cut off the line 12. The axially extending guide tracks 50, 52 of the sliding blocks 30, 32 are mounted each in a movable manner along their own axially extending guide strip 54, 56 on the side plates 24, 26 (not shown). Furthermore, a longitudinal side of each guide strip 54, 56 is provided with locking grooves in the form of transverse flutes 80 facing outwardly toward the locking knob point 76. When each sliding block 30, 32 is moving downwardly after release, the respective locking knob point 76 will be biased against the flutes 80 simultaneous with the point 76 sliding across the flutes 80 due to the oblique position of the locking knob 72 upwards toward the respective guide strip 54, 56. Upon attempting to move a sliding bloc 30, 32 in the opposite direction and upwards, however, the oblique position of the locking knob 72 will ensure that the point 76 enter into locking engagement with the flutes 80. This is shown best in FIG. 8. FIG. 9 shows another perspective of the same situation, but wherein the fluted gripping faces 42, 44 of the sliding blocks 30, 32 fixedly grip around the cut off line 12. By means of the locking knob 72 and the flutes 80, each sliding block 30, 32 is arranged for locking engagement with the conical box 18.

In order then to liberate the sliding blocks 30, 32 and thus the line 12, each locking knob 72 must rotate out of engagement with the flutes 80 and to a retracted, free position. If each locking knob 72 and activation pin 78 includes a magnet-affectable material, they advantageously may be connected to an electromagnet (not shown) which, upon activation, pulls both the locking knob 72 and the activation pin 78 back to said free position. For example, such an electromagnet and associated energy source (not shown) may be incorporated into the very sliding block 30, 32 or within said borehole bushing 4, and preferably it is connected to a remote control device for remotely controlled activation of the magnet.

Upon activation, the electromagnet will pull the activation pin 78 into the respective sliding block 30, 32, simultaneously being accompanied by the locking knob 72 rotating out of engagement with the flutes 80 onto said rectracted, free position. Then the liberated line 12 may be pulled out of the well in a controlled manner.

In order to intensify the cutting effect, the sliding block may also include at least one weight 57*a*, 57*b* (see FIG. 6) for gravity-assisted movement of the sliding block 30, 32 upon release thereof.

The invention claimed is:

1. A cutting device for emergency cutting of a line at an upper portion of a well when said line is moving downward into the well, the cutting device being arranged for incorporation of the line:

wherein the cutting device comprises:

a tapering guide arranged for stationary positioning relative to said upper portion of the well, said tapering guide including a narrow end portion and a wide end portion for feed-through of the line, the narrow end portion being placed, when in its position of use, at a lower position than that of the wide end portion;

at least one sliding block arranged axially movable within the tapering guide, thereby allowing the at least one sliding block, when in its position of use, to move downward, by virtue of gravity, from the wide end portion to the narrow end portion of the tapering guide; and at least one cutting knife connected to the at least one sliding block and directed inwards toward the center of the tapering guide, thereby allowing the at least one cutting knife to move downward along with the at least one sliding block until engaging and cutting off said downwardly moving line, the downward movement of the line contributing to pull the at least one knife toward the center of the tapering guide so as to facilitate the cutting of the line;

wherein the cutting device also comprises at least one releasable holding mechanism for standby holding of the at least one sliding block at the wide end portion of the guide, and for releasing the at least one sliding block in connection with emergency cutting of the line moving in a downward direction through the stationary tapering guide;

wherein the at least one sliding block includes a magnet-affectable material, and wherein the releasable holding mechanism is comprised of an electromagnet for releasable standby holding of the at least one magnet-affectable sliding block.

2. The cutting device according to claim 1, wherein the tapering guide is assembled from at least two axially extending and non-parallel face elements.

3. The cutting device according to claim 1, wherein the tapering guide is comprised of a conical funnel.

4. The cutting device according to claim 1, wherein the cutting device includes at least two sliding blocks, insofar as the sliding blocks, upon release, will move downward and force their cutting knives against the downwardly moving line.

5. The cutting device according to claim 4, wherein the cutting knives are arranged in a scissor configuration for clipping off the downwardly moving line.

6. The cutting device according to claim 1, wherein a sliding side of the at least one sliding block is provided with at least one axially extending guide track arranged for cooperation with at least one axially extending guide strip provided at an inside of the guide.

7. The cutting device according to claim 1, wherein a sliding side of the at least one sliding block is provided with at least one axially extending guide strip arranged for cooperation with at least one axially extending guide track provided at an inside of the guide.

8. The cutting device according to claim 1, wherein a gripping side of the at least one sliding block includes an axially extending gripping face bevelled toward an inside of the guide and bevelled in the direction of the wide end portion of the guide.

9. The cutting device according to claim 8, wherein the gripping face forms an angle which, relative to a longitudinal axis through the guide, is larger than that of a corresponding angle formed by the inside of the guide.

10. The cutting device according to claim 1, wherein the at least one sliding block includes at least one weight for gravity-assisted movement of the at least one sliding block upon release thereof.

11. The cutting device according to claim 1, wherein the releasable holding mechanism is connected to a remote control device for remotely controlled release of the holding mechanism.

12. The cutting device according to claim 1, wherein the cutting device also comprises at least one releasable locking mechanism for locking of the at least one sliding block in a region at the narrow end portion of the guide after cutting off the downwardly moving line.

13. The cutting device according to claim 12, wherein the releasable locking mechanism is connected to a remote control device for remotely controlled release thereof after said locking of the at least one sliding block in a region at the narrow end portion of the guide.

14. The cutting device according to claim 1, wherein the cutting device is incorporated in a borehole slips.

15. The cutting device according to claim 14, wherein the cutting device is incorporated in a spider-type borehole slips.

16. The cutting device according to claim 1, wherein the cutting device is incorporated in a borehole bushing.

17. A cutting device for emergency cutting of a line at an upper portion of a well when said line is moving downward into the well, the cutting device being arranged for incorporation of the line:

wherein the cutting device comprises:

a tapering guide arranged for stationary positioning relative to said upper portion of the well, said tapering guide including a narrow end portion and a wide end portion for feed-through of the line, the narrow end portion being placed, when in its position of use, at a lower position than that of the wide end portion;

at least one sliding block arranged axially movable within the tapering guide, thereby allowing the at least one sliding block, when in its position of use, to move downward, by virtue of gravity, from the wide end portion to the narrow end portion of the tapering guide; and at least one cutting knife connected to the at least one sliding block and directed inwards toward the center of the tapering guide, thereby allowing the at least one cutting knife to move downward along with the at least one sliding block until engaging and cutting off said downwardly moving line, the downward movement of the line contributing to pull the at least one knife toward the center of the tapering guide so as to facilitate the cutting of the line;

wherein the cutting device also comprises at least one releasable holding mechanism for standby holding of the at least one sliding block at the wide end portion of the guide, and for releasing the at least one sliding block in connection with emergency cutting of the line moving in a downward direction through the stationary tapering guide;

wherein the cutting device also comprises at least one releasable locking mechanism for locking of the at least one sliding block in a region at the narrow end portion of the guide after cutting off the downwardly moving line;

wherein the releasable locking mechanism is arranged for locking engagement between the at least one sliding block and the guide.

18. The cutting device according to claim 17, wherein said at least one sliding block is provided with at least one locking dog, and wherein the guide is provided with at least one cooperating locking groove.

19. The cutting device according to claim 17, wherein said at least one sliding block is provided with at least one locking groove, and wherein the guide is provided with at least one cooperating locking dog.

20. The cutting device according to claim 17, wherein the tapering guide is assembled from at least two axially extending and non-parallel face elements.

21. The cutting device according to claim 17, wherein the tapering guide is comprised of a conical funnel.

22. The cutting device according to claim 17, wherein the cutting device includes at least two sliding blocks, insofar as the sliding blocks, upon release, will move downward and force their cutting knives against the downwardly moving line.

23. The cutting device according to claim 22, wherein the cutting knives are arranged in a scissor configuration for clipping off the downwardly moving line.

24. The cutting device according to claim 17, wherein a sliding side of the at least one sliding block is provided with at least one axially extending guide track arranged for cooperation with at least one axially extending guide strip provided at an inside of the guide.

25. The cutting device according to claim 17, wherein a sliding side of the at least one sliding block is provided with at least one axially extending guide strip arranged for cooperation with at least one axially extending guide track provided at an inside of the guide.

26. The cutting device according to claim 17, wherein a gripping side of the at least one sliding block includes an axially extending gripping face bevelled toward an inside of the guide and bevelled in the direction of the wide end portion of the guide.

27. The cutting device according to claim 26 wherein the gripping face forms an angle which, relative to a longitudinal axis through the guide, is larger than that of a corresponding angle formed by the inside of the guide.

28. The cutting device according to claim 17, wherein the at least one sliding block includes at least one weight for gravity-assisted movement of the at least one sliding block upon release thereof.

29. The cutting device according to claim 17, wherein the releasable holding mechanism is connected to a remote control device for remotely controlled release of the holding mechanism.

30. The cutting device according to claim 17, wherein the cutting device also comprises at least one releasable locking mechanism for locking of the at least one sliding block in a region at the narrow end portion of the guide after cutting off the downwardly moving line.

31. The cutting device according to claim 30, wherein the releasable locking mechanism is connected to a remote control device for remotely controlled release thereof after said locking of the at least one sliding block in a region at the narrow end portion of the guide.

32. The cutting device according to claim 17, wherein the cutting device is incorporated in a borehole slips.

33. The cutting device according to claim 32, wherein the cutting device is incorporated in a spider-type borehole slips.

34. The cutting device according to claim 17, wherein the cutting device is incorporated in a borehole bushing.

35. A cutting device for emergency cutting of a line at an upper portion of a well when said line is moving downward into the well, the cutting device being arranged for incorporation of the line:

wherein the cutting device comprises:

a tapering guide arranged for stationary positioning relative to said upper portion of the well, said tapering guide including a narrow end portion and a wide end portion for feed-through of the line, the narrow end portion being placed, when in its position of use, at a lower position than that of the wide end portion;

at least one sliding block arranged axially movable within the tapering guide, thereby allowing the at least one sliding block, when in its position of use, to move downward, by virtue of gravity, from the wide end portion to the narrow end portion of the tapering guide; and at least one cutting knife connected to the at least one sliding block and directed inwards toward the center of the tapering guide, thereby allowing the at least one cutting knife to move downward along with the at least one sliding block until engaging and cutting off said downwardly moving line, the downward movement of the line contributing to pull the at least one knife toward the center of the tapering guide so as to facilitate the cutting of the line;

wherein the cutting device also comprises at least one releasable holding mechanism for standby holding of the at least one sliding block at the wide end portion of the guide, and for releasing the at least one sliding block in connection with emergency cutting of the line moving in a downward direction through the stationary tapering guide;

wherein the cutting device also comprises at least one releasable locking mechanism for locking of the at least one sliding block in a region at the narrow end portion of the guide after cutting off the downwardly moving line;

wherein the inside of the tapering guide is formed with a Morse taper for self-locking of the at least one sliding block when being forced against the guide during cutting of the downwardly moving line, said self-locking of the at least one sliding block against the guide constituting said locking mechanism.

36. The cutting device according to claim 35, wherein the tapering guide is assembled from at least two axially extending and non-parallel face elements.

37. The cutting device according to claim 35, wherein the tapering guide is comprised of a conical funnel.

38. The cutting device according to claim 35, wherein the cutting device includes at least two sliding blocks, insofar as the sliding blocks, upon release, will move downward and force their cutting knives against the downwardly moving line.

39. The cutting device according to claim 38, wherein the cutting knives are arranged in a scissor configuration for clipping off the downwardly moving line.

40. The cutting device according to claim 35, wherein a sliding side of the at least one sliding block is provided with at least one axially extending guide track arranged for cooperation with at least one axially extending guide strip provided at an inside of the guide.

41. The cutting device according to claim 35, wherein a sliding side of the at least one sliding block is provided with at least one axially extending guide strip arranged for cooperation with at least one axially extending guide track provided at an inside of the guide.

42. The cutting device according to claim 35, wherein a gripping side of the at least one sliding block includes an axially extending gripping face bevelled toward an inside of the guide and bevelled in the direction of the wide end portion of the guide.

43. The cutting device according to claim 42 wherein the gripping face forms an angle which, relative to a longitudinal axis through the guide, is larger than that of a corresponding angle formed by the inside of the guide.

44. The cutting device according to claim 35, wherein the at least one sliding block includes at least one weight for gravity-assisted movement of the at least one sliding block upon release thereof.

45. The cutting device according to claim 35, wherein the releasable holding mechanism is connected to a remote control device for remotely controlled release of the holding mechanism.

46. The cutting device according to claim 35, wherein the cutting device also comprises at least one releasable locking mechanism for locking of the at least one sliding block in a region at the narrow end portion of the guide after cutting off the downwardly moving line.

47. The cutting device according to claim 46, wherein the releasable locking mechanism is connected to a remote control device for remotely controlled release thereof after said locking of the at least one sliding block in a region at the narrow end portion of the guide.

48. The cutting device according to claim 35, wherein the cutting device is incorporated in a borehole slips.

49. The cutting device according to claim 48, wherein the cutting device is incorporated in a spider-type borehole slips.

50. The cutting device according to claim 35, wherein the cutting device is incorporated in a borehole bushing.

51. A method for emergency cutting of a line at an upper portion of a well when said line is moving downward into the well, the method comprising the following steps:

using a cutting device comprising the following features:

a tapering guide including a narrow end portion and a wide end portion;

at least one sliding block arranged axially movable within the tapering guide;

at least one cutting knife connected to the sliding block and directed inwards toward the center of the tapering guide; and at least one releasable holding mechanism for the at least one sliding block;

placing the tapering guide in a stationary position relative to said upper portion of the well;

placing the narrow end portion at a lower position than that of the wide end portion of the tapering guide;

by means of said holding mechanism, holding the at least one sliding block in a standby position at the wide end portion of the tapering guide;

feeding the line through the tapering guide and into the well; and when emergency cutting of the downwardly moving line is required, releasing said holding mechanism so as to liberate the at least one sliding block;

allowing the at least one sliding block to move downward, by virtue of gravity, from the wide end portion to the narrow end portion of the tapering guide, thereby allowing the at least one cutting knife to move downward along with the at least one sliding block until engaging and cutting off said downwardly moving line, the downward movement of the line contributing to pull the at least one knife toward the center of the tapering guide so as to facilitate the cutting of the line; and releasing said locking mechanism by means of remote control after locking of the at least one sliding block at the narrow end portion of the guide.

52. The method according to claim 51, comprising releasing said holding mechanism by means of remote control.

53. The method according to claim 51, comprising incorporating the cutting device in a borehole slips.

54. The method according to claim 53, comprising incorporating the cutting device in a spider-type borehole slips.

55. The method according to claim 51, comprising incorporating the cutting device in a borehole bushing.

56. A cutting device for emergency cutting of a line in a well, the cutting device being arranged for incorporation of the line and also for connection to the well, wherein the cutting device comprises:

a tapering guide including a narrow end portion and a wide end portion for feed-through of the line, the narrow end portion being placed, when in its position of use, at a lower position than that of the wide end portion;

at least one sliding block arranged axially movable within the tapering guide; and at least one cutting knife connected to the sliding block and directed inwards toward the center of the tapering guide, wherein the cutting device also comprises at least one releasable holding mechanism for standby holding of the at least one sliding block at the wide end portion of the guide, and for releasing the at least one sliding block in connection with emergency cutting of the line;

insofar as the at least one sliding block, upon release, will move downward in the direction of the narrow end portion of the guide where it will force its at least one cutting knife with increasing force against the line;

wherein the sliding block includes a magnet-affectable material, and wherein the releasable holding mechanism is comprised of an electromagnet for releasable standby holding of the magnet-affectable sliding block.

57. A cutting device for emergency cutting of a line in a well, the cutting device being arranged for incorporation of the line and also for connection to the well, wherein the cutting device comprises the following features:

a tapering guide including a narrow end portion and a wide end portion for feed-through of the line, the narrow end portion being placed, when in its position of use, at a lower position than that of the wide end portion;

at least one sliding block arranged axially movable within the tapering guide; and at least one cutting knife connected to the sliding block and directed inwards toward the center of the tapering guide, wherein the cutting device also comprises at least one releasable holding mechanism for standby holding of the at least one sliding block at the wide end portion of the guide, and for releasing the at least one sliding block in connection with emergency cutting of the line;

insofar as the at least one sliding block, upon release, will move downward in the direction of the narrow end portion of the guide where it will force its at least one cutting knife with increasing force against the line;

wherein the cutting device also comprises at least one releasable locking mechanism for locking of the at least one sliding block in a region at the narrow end portion of the guide after cutting off the line;

wherein the releasable locking mechanism is arranged for locking engagement between the at least one sliding block and the guide.

58. The cutting device according to claim 57, wherein said at least one sliding block is provided with at least one locking dog, and wherein the guide is provided with at least one cooperating locking groove.

59. The cutting device according to claim 57, wherein said at least one sliding block is provided with at least one locking groove, and wherein the guide is provided with at least one cooperating locking dog.

60. A cutting device for emergency cutting of a line in a well, the cutting device being arranged for incorporation of the line and also for connection to the well, wherein the cutting device comprises the following features:

a tapering guide including a narrow end portion and a wide end portion for feed-through of the line, the narrow end portion being placed, when in its position of use, at a lower position than that of the wide end portion;

at least one sliding block arranged axially movable within the tapering guide; and at least one cutting knife connected to the sliding block and directed inwards toward the center of the tapering guide, wherein the cutting device also comprises at least one releasable holding mechanism for standby holding of the at least one sliding block at the wide end portion of the guide, and for releasing the at least one sliding block in connection with emergency cutting of the line;

insofar as the at least one sliding block, upon release, will move downward in the direction of the narrow end portion of the guide where it will force its at least one cutting knife with increasing force against the line;

wherein the cutting device also comprises at least one releasable locking mechanism for locking of the at least one sliding block in a region at the narrow end portion of the guide after cutting off the line;

wherein the inside of the tapering guide is formed with a Morse taper for self-locking of the at least one sliding block when being forced against the guide during cutting of the line, the constellation of which forms a releasable locking mechanism.

61. A method for emergency cutting of a line in a well, the method comprising the following steps:

using a cutting device comprising the following features:

a tapering guide including a narrow end portion and a wide end portion;

at least one sliding block arranged axially movable within the tapering guide;

at least one cutting knife connected to the sliding block and directed inwards toward the center of the tapering guide;

at least one releasable holding mechanism for the at least one sliding block;

at least one releasable locking mechanism for locking of the at least one sliding block in a region at the narrow end portion of the guide after cutting off the line; and connecting the cutting device to the well and placing the narrow end portion at a lower position than that of the wide end portion;

by means of said holding mechanism, holding the at least one sliding block in a standby position at the wide end portion of the guide;

introducing the line through the cutting device and into the well;

when emergency cutting of the line is required, releasing said holding mechanism and thereby liberating the at least one sliding block, whereupon the sliding block will move downward in the direction of the narrow end portion of the guide where it will force its at least one cutting knife with increasing force against the line until it is cut off; and releasing said locking mechanism by means of remote control after locking of the at least one sliding block at the narrow end portion of the guide.

* * * * *